US010583453B2

(12) United States Patent
Landa et al.

(10) Patent No.: US 10,583,453 B2
(45) Date of Patent: Mar. 10, 2020

(54) PRODUCT METERING DEVICE

(71) Applicant: Landa Labs (2012) LTD., Rehovot (IL)

(72) Inventors: Benzion Landa, Nes Ziona (IL); Anton Krassilnikov, Durham, NH (US)

(73) Assignee: LANDA LABS (2012) LTD, Rehovot (IL)

( * ) Notice: Subject to any disclaimer, the term of this patent is extended or adjusted under 35 U.S.C. 154(b) by 0 days.

(21) Appl. No.: 15/748,319

(22) PCT Filed: Aug. 17, 2016

(86) PCT No.: PCT/IB2016/054933
§ 371 (c)(1),
(2) Date: Jan. 29, 2018

(87) PCT Pub. No.: WO2017/029623
PCT Pub. Date: Feb. 23, 2017

(65) Prior Publication Data

US 2018/0200748 A1 Jul. 19, 2018

(30) Foreign Application Priority Data

Aug. 17, 2015 (GB) ..... 1514620.2

(51) Int. Cl.
*B05C 11/06* (2006.01)
*B05C 11/02* (2006.01)
(Continued)

(52) U.S. Cl.
CPC ..... *B05C 11/06* (2013.01); *B05C 11/023* (2013.01); *D21H 5/007* (2013.01); *D21H 25/16* (2013.01); *F26B 21/004* (2013.01)

(58) Field of Classification Search
CPC ..... B05C 11/06; B05C 11/023; D21H 25/16; D21H 5/007; B05B 1/005; B08B 5/00; F26B 21/00; F26B 21/004; C23C 2/20
(Continued)

(56) References Cited

U.S. PATENT DOCUMENTS 3,383,239 A * 5/1968 Christman, Jr. ..... B05D 3/04 118/63
3,929,097 A * 12/1975 Kanda ..... B05C 1/0834 118/246
(Continued)

FOREIGN PATENT DOCUMENTS

| | | |
|---|---|---|
| CN | 103206846 | 7/2013 |
| GB | 2466631 | 7/2010 |
| WO | WO2013064690 | 5/2013 |

*Primary Examiner* — Laura Edwards
(74) *Attorney, Agent, or Firm* — Shalom Wertsberger; Saltamar Innovations

(57) ABSTRACT

A metering device is disclosed for regulating the depth of flowable product coating a surface movable relative to the metering device by directing an air curtain towards the surface. The metering device comprises a body (10) having an interior chamber (12), an inlet for connecting the chamber to a source of gas under super-ambient pressure; and an opening (16) communicating with the chamber and having a mouth through which gas is discharged from the chamber towards the surface to form the air curtain. A porous or reticulated membrane (18) is secured to, or formed integrally with, the body of the device to lie in the path of the gas discharged through the mouth of the opening.

16 Claims, 2 Drawing Sheets

(51) Int. Cl.
*F26B 21/00* (2006.01)
*D21H 25/16* (2006.01)

(58) Field of Classification Search
USPC ..... 118/62, 63
See application file for complete search history.

(56) References Cited

U.S. PATENT DOCUMENTS

| | | | | |
|---|---|---|---|---|
| 4,041,895 | A | 8/1977 | Overton | |
| 6,376,020 | B1 * | 4/2002 | Tu | B05C 11/06 118/63 |
| 2004/0168784 | A1 * | 9/2004 | Duan | D21F 7/008 162/275 |
| 2009/0031579 | A1 * | 2/2009 | Piatt | B41J 11/002 34/82 |
| 2009/0044702 | A1 * | 2/2009 | Adamek | B01D 39/163 95/287 |
| 2011/0000427 | A1 * | 1/2011 | Bobson | F26B 21/004 118/64 |
| 2011/0192917 | A1 | 8/2011 | Chen | |
| 2015/0028138 | A1 | 1/2015 | Dubois | |

* cited by examiner

PRODUCT METERING DEVICE

FIELD

The present disclosure relates to a product metering device for regulating the depth, or leveling, of a flowable product coating a surface that is movable relative to the metering device by directing an air curtain towards the surface. The invention also relates to a surface coating system incorporating such a metering device.

BACKGROUND

Devices used to produce an air curtain, sometimes also termed air knives, typically comprise a chamber connected to a source of pressurized air, from which chamber air is discharged to the ambient atmosphere through an elongate opening. The air curtain is directed towards a surface that moves relative to it, the air in the air curtain usually traveling in a direction normal to the surface. The air curtain may serve different purposes such as drying the surface, blowing away debris, confining material on the surface of a conveyor, removing or controlling the thickness of an applied liquid layer and separating particles by size. Such air curtains are typically characterized by high exit air flow which in turn creates a high intensity of impact air onto the surface towards which the compressed air is directed.

SUMMARY

There is herein proposed, in accordance with a first aspect, a product metering device for regulating the depth, or leveling, of a flowable product coating a surface that is movable relative to the metering device by directing an air curtain towards the surface, the metering device comprising a body having an interior chamber, an inlet for connecting the chamber to a source of gas under super-ambient pressure; and an opening communicating with the chamber and having a mouth through which gas is discharged from the chamber towards the surface to form the air curtain; wherein a porous or reticulated flow regulating membrane is secured to, or formed integrally with, the body of the device to lie in the path of the gas discharged through the mouth of the opening.

The term "flowable product" is used herein to include both a liquid product and a flowable solid product, such as a powder or other particulate material.

The term "opening" a used herein is intended to include both a single slot and a series of holes through which a curtain of air can be discharged. The outermost portion of the opening is referred to its mouth. The opening or its mouth may have any shape suitable to conform to the opposing surface. For instance, they can assume the form of an elongated quadrilateral, or a curve, or any other closed or open shape, allowing the mouth of the opening to be substantially equidistant from the opposing surface towards which the gas is to be discharged. The facing surface may be a flat plane or a cylinder, or assume any other shape which may be advantageous for the intended use.

Though in the present disclosure, certain terms are used in connection with "air" as often used in the field, such a product metering device can be operated with other gases and for instance an "air curtain" can be formed by the discharge of any other compressed gas through the mouth of the opening. The term "air" needs therefore not to be construed as limiting.

When conventional air knives (without a flow regulating membrane) are used with small gaps between the air exit and the surface facing it, the pressure in the gap may remain relatively high and similar to the pressure within the chamber. The equilibrium with ambient pressure is achieved "laterally" thanks to the flow rate created, predominantly against the direction of movement of the surface. Such contact-less air knives are generally operated under relatively high pressure and high flow in a direction parallel to movement of the surface.

For some applications the impact air velocity onto the surface of whatever object the air is directed towards, needs be controlled. For instance, too strong an impact air flow or velocity may alter or damage the facing surface. Too low an exit air flow or velocity, on the other hand, may hamper the efficacy of the air knife for its intended use, and/or require a narrowing of the distance to the surface to reduce a further loss of velocity between exit and impact. With a conventional air knife, such narrowing is however not realistic below a certain gap for practical engineering considerations that are readily appreciated by persons skilled in the use of such devices. Though a desired distance between a product metering device and its targeted surface may vary with the intended use, conventional air knives can rarely be positioned closer than about 6 mm.

The product metering device proposed herein differs from a conventional product metering device by the presence of a membrane covering (and partially masking) the mouth of the opening. The membrane presents a flow restriction in the path of the air flow and allows the flow rate of the air stream to be reduced without decreasing the pressure in the gap between the mouth of the opening and the opposing surface of a conveyor. In other words, while for a given inner pressure $P_i$ (i.e. in the interior chamber), a conventional product metering device seeks to achieve a relatively high pressure drop between $P_i$ and ambient pressure downstream of the opening to generate a relatively high flow rate, the attachment of a membrane to the opening contrarily seeks to achieve a relatively low pressure drop downstream of the opening, the flow rate being concomitantly dramatically reduced as compared to a similar reference device lacking the membrane. A suitable membrane, which shall be described in more details in the following, can also be termed a flow regulating membrane.

In some embodiments of the invention, the flow regulating membrane is designed and configured such that in an ambient mode (T=25° C., the gas is air, the distance between the metering device and the surface is substantially infinite), the membrane exerts a minimum back-pressure with respect to said chamber, such that a pressure differential ΔP−am defined by $$\Delta P\text{-}am = P\text{chamber}\text{-}am - P\text{ambient}$$

where=Pchamber−am is the pressure in the chamber and Pambient is the ambient pressure, ΔP−am is at least 0.2 bar, at least 0.4 bar, at least 0.7 bar, at least 1 bar, at least 1.5 bar, at least 2 bar, at least 3 bar, at least 5 bar, at least 10 bar, or at least 20 bar. The term "minimum back-pressure" refers herein to the minimum pressure differential required across the membrane to achieve any gas flow therethrough.

One can also characterize the flow resistance of the flow regulating membrane by the difference that its presence makes to the pressure in the chamber. In some embodiments, with the metering device in the ambient mode and with said membrane detached from the product metering device, a membraneless pressure differential ΔPml is defined by:

$$\Delta Pml = P\text{chamber}\text{-}ml - P\text{ambient};$$

wherein Pchamber−ml is the back pressure in the chamber in the absence of a membrane, and a differential pressure ratio RΔP is defined by:

$$R\Delta P=\Delta P-am/\Delta Pml;$$

said differential pressure ratio is at least 7, at least 10, at least 15, at least 20, at least 30, at least 50, or at least 100.

In contrast to conventional air knives that are typically placed a distance of several millimeters from the surface towards which the air curtain is directed, the use of a flow regulating membrane permits the distance between the mouth of opening and the surface to be less than 4 mm, or less than 2 mm, or less than 1 mm or less than 0.5 mm.

In some embodiments of the disclosure, the air curtain flows substantially without turbulence in a gap between the metering device and the surface in order to achieve an even depth of product coating on the surface on the downstream side of the device. In some embodiment, such even product coating may display variations in coating depth of less than 10%, or less than 5%, or less than 2% or less than 1% of the average depth of the coating. Such coating depth can be measured by appropriate instrumentation permitting the determination of the thickness of the product coating above the surface. Depending on the coating depth of relevance suitable measuring techniques may involve microscopes or any other thickness measuring instrument of desired accuracy and precision for the pertinent range of dimensions. Such measures are typically repeated at a number of points (e.g., at least 10) along the width and length of the targeted surface and their mean values calculated to set the average depth of a particular product coating.

While it has been reported that developers of new conventional air knives typically strive to improve the flow rate efficiency that may be discharged by a particular design of the plenum chamber or openings, a product metering device according to the present teachings seeks to restrain such effect.

In operative settings, the product metering device is mounted at a predetermined distance from the target surface. As the materials displaceable by use of the metering device (e.g., liquids or flowable solids) typically form a very thin layer on the counter surface (e.g., of a conveyer), for all practical purposes the target surface is the counter surface itself. The product metering device openings typically extend in a direction perpendicular to the traveling direction of the counter surface. The distance between the outer surface of the membrane and the target surface in a direction perpendicular to the impacted counter surface can be called the mounting gap. In some embodiments, the mounting gap is of about 2.0 mm or less, 1.5 mm or less, or 1.0 mm or less. The mounting gap can be as narrow as 900 μm or less, 800 μm or less, 700 μm or less, 600 μm or less, 500 μm or less, 400 μm or less, or 300 μm or less; the mounting gap being optionally of at least 50 μm or at least 100 μm. In particular embodiments, the mounting gap is in the range of 200 μm to 1200 μm or in the range of 0.5 mm to 1.0 mm.

Such an inventive product metering device has, in particular, been found more efficient when coating a surface with dry material (e.g., with a thin layer of particles, or even with a monolayer thereof), for the size classification of solid particles and in the control of the thickness of a liquid applied on the surface facing the product metering device, predominantly confining excess material (whether in dry or liquid form) in the area upstream of the product metering device.

According to a second aspect of the present disclosure, there is proposed a system for applying to a surface an even coating of a flowable product, in which system an excess of the product is placed on the surface and the surface is moved beneath a metering device that directs an air curtain towards the surface in order to spread the product evenly over the surface in order to achieve a desired coating depth, wherein the metering device comprises a body having an interior chamber, an inlet connecting the chamber to a source of gas under super-ambient pressure; and an opening communicating with the chamber and having a mouth through which gas is discharged from the chamber towards the surface to form the air curtain, and wherein a porous or reticulated flow regulating membrane is secured to, or formed integrally with, the body of the device to lie in the path of the gas discharged through the mouth of the opening.

According to a third aspect of the present disclosure, there is proposed a method for applying to a surface an even coating of a flowable product, the method relying on the afore-described product metering device or system.

BRIEF DESCRIPTION OF THE DRAWINGS

An embodiment will now be described by way of example with reference to the accompanying drawings, in which.

DETAILED DESCRIPTION

The ensuing description, together with the figures, makes apparent to a person having ordinary skill in the pertinent art how the teachings of the disclosure may be practiced. The figures are for the purpose of illustrative discussion and no attempt is made to show structural details of an embodiment in more detail than is necessary for a fundamental understanding of the disclosure. For the sake of clarity and simplicity, some objects depicted in the figures may not be drawn to scale.

Figure 1:
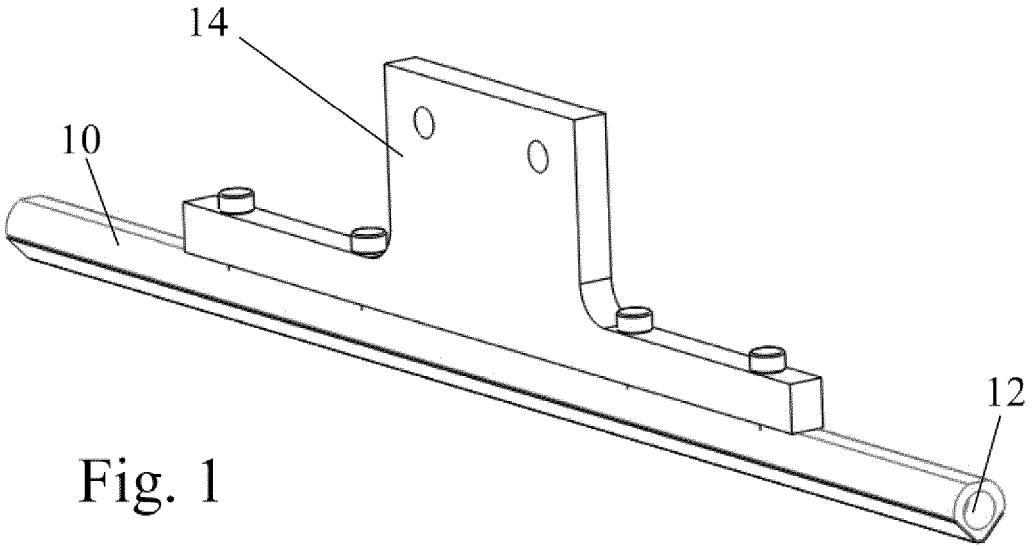
FIG. 1 is a perspective view of a product metering device.
Figure 2:
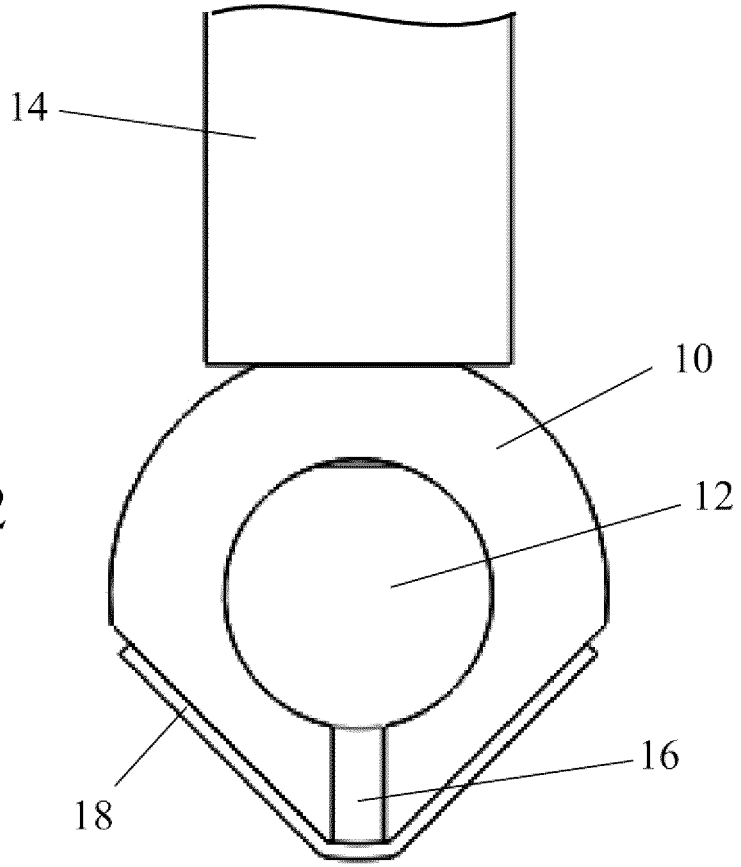
FIG. 2 is a section through part of the product metering device shown in FIG. 1.
Figure 3:
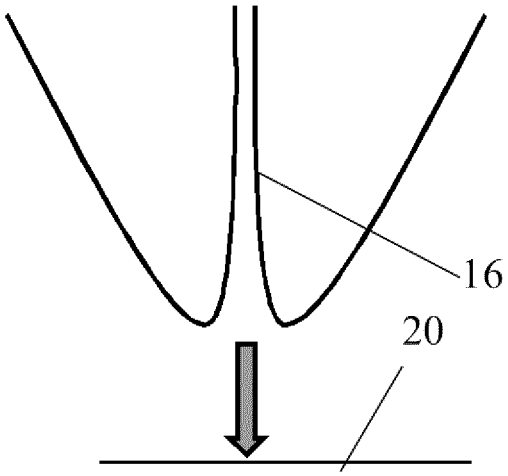
FIG. 3 shows schematically the mouth of the discharge opening of a conventional product metering device.
Figure 4:
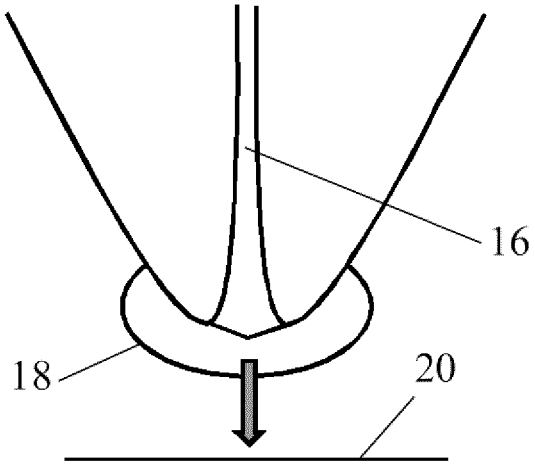
FIG. 4 is a view similar to that of FIG. 3, showing the mouth of the discharge opening of the product metering device of FIGS. 1 and 2.

The product metering device shown in FIGS. 1 and 2 comprises an elongate tube-like body 10 defining an interior chamber 12. The body 10 is mounted above the surface 20 of a conveyor (shown in FIGS. 3 and 4) by means of a support bracket 14. Typically, the length of the tube-like body is commensurate with the width of the conveyor, the length of the body being perpendicular to the direction of relative movement. Air enters under super-ambient pressure into the chamber 12 through an inlet (not shown) at or near one end of the body 10 from a suitable source, such as a compressor or a blower. As an alternative, the gas may be introduced into the chamber by an inlet positioned in the center of the body and/or by two or more inlets positioned along the body.

The pressure within the chamber can be of up to 10,000 kPa, or up to 2,000 kPa, or up to 1,000 kPa and is typically between 200 kPa and 1,000 kPa or between 200 kPa and 800 kPa. A discharge opening 16, elongated in a direction normal to the plane of FIG. 2, allows compressed gas to escape from the chamber 12 to create an air curtain.

The product metering device in FIGS. 1 and 2 differs from conventional air knives by the provision of a porous or reticulated flow regulating membrane 18 that is secured to the outer surface of the body 10 to overlie the mouth of the opening 16. The method of attachment of the membrane 18 to the body 10 is not critical and it may even be formed integrally with the body 10 by the use of 3D printing. Though in the present figures, the opening of the product metering device is illustrated as an elongated line; such shape need not be construed as limiting. An elongated line, if preferred for any particular use, can have any width suitable for the desired effect. In one embodiment, the opening has an elongated shape having a width in the range of 0.1-2.5 mm or 0.5-2.0 mm.

If reticulated, the membrane may be formed of an organic or inorganic material, such as a plastics material, a ceramic, a silica, a metal, or a combination thereof, that is impervious to gas but that is formed with fine holes to allow the gas (e.g., air) to pass through it. Thus the membrane may be a perforated sheet of any such materials (e.g., of an inorganic metal or of an organic plastic polymer) or a mesh of woven or unwoven fibers of the same (e.g., of glass, metal or plastics fibers). If porous, the fabric of the membrane may itself have micro-pores that allow gas to pass through (also often termed "open cells").

Membranes, whether made of organic plastic polymers, inorganic materials or composites of both types, are known and commercially available in various flow configurations. Porous plastic membranes can be made of various thermoplastic materials including at least one of ethylene vinyl acetate (EVA), high-density polyethylene (HDPE), polyamide (PA), polycarbonate (PC), polyethylene (PE), polyethersulfone (PES), polyester (PET), polypropylene (PP), polytetrafluoroethylene (PTFE), polyurethane (PU or TPU), polyvinylidene fluoride (PVDF), and ultra-high molecular weight polyethylene (UHMWPE). Co-polymers can for instance be made of PE/PET, PE/PP, and PC/ABS (acrylonitrile-butadiene styrene), to name a few.

Inorganic membranes can be made of ceramics, such as aluminum oxide, silicon carbide, titanium oxide and zirconium oxide, or glassy materials, such as borosilicate. Inorganic porous membranes can also be made of metals, such as aluminum, nickel and titanium, or oxides thereof, and of alloys, such as bronze, nickel alloys and stainless steel.

Membranes can also be composite of organic and inorganic materials, whether each constituting a separate layer of the membrane (e.g., one material supporting the other) and/or all jointly forming the membrane. Such a composite membrane can, for example, include a plastic polymer, and a metal and/or glass fibers.

As readily understood, the various chemical types and physical structures of the membranes which may serve for a product metering device according to present teachings can provide for various surface properties, such as hydrophilicity or hydrophobicity, and smoothness or roughness, to name but a few. Information concerning such properties are typically provided by the membrane suppliers, but can be readily assessed by standard methods. Any such property of the flow regulating membrane can be acceptable, as long as it is compatible with the desired pressurized gas flow rate and pattern, the flow pattern additionally depending on the gap between the membrane and the surface (be it solid or liquid) towards which the product metering device would be directed. The suitability of any membrane for a particular purpose can be established through routine experimentation by a skilled person.

Though working in a non-contact mode in the direction of the surface, the membrane may in some cases contact a liquid, or other materials, to be constrained by the product metering device on its upstream side, though not in the region of the mouth of the opening 16. For example, if the product metering device is directed at a liquid coated conveyor to control the thickness of the liquid film coating the conveyor after passing beneath the product metering device, the height of a dam of liquid created upstream of the mouth of the product metering device may be sufficient for it to contact with the side of the body of the product metering device, even though the air stream will prevent the liquid from contacting the mouth of the product metering device. In such situation, it is further desired for the membrane to be chemically inert and resistant with respect to such optionally contacting liquids or materials.

Depending on the upstream gas pressure in the chamber and/or the desired flow rate at the mouth of the opening, the membrane may vary and, amongst other things, may for example have different thicknesses (e.g., up to 1 mm) and/or fine holes and/or mesh density and/or micro-pores. It is desired that the passages or voids allowing the gas to traverse the membrane should be substantially uniform over the area of the mouth, so as to obtain essentially the same flow rate along all opening positions. Advantageously such pores or passages have a substantially constant structure over time. The structural stability of the membrane (and holes or micro-pores therein) can prolong the lifespan of the product metering device and/or reduce the need for membrane replacement. A membrane or product metering device would be considered less suitable, hence also reaching its end life, once the flow rate of the gas is no longer uniform nor controllable under application of predetermined upstream pressure.

The diameter of the fine holes, or mesh apertures or micro-pores of a membrane suitable for the present teachings is of 100 micrometer (μm) or less, typically of 50 μm or less, or 30 μm or less, generally of 20 μm or less, or of 10 μm or less, or of 8 μm or less, or of 6 μm or less, or of 4 μm or less, or of 2 μm or less, and even of 1 μm or less. However, such holes, apertures or micro-pores need not be too small, as the membranes would then form excessive resistance to the flow rate and/or require increased gas pressure in the chamber. Suitable membranes therefore typically include passages of at least 1 nanometer, at least 10 nm, at least 100 nm or at least 200 nm. Diameters in the range of 100 nm to 10 μm, or even 1 μm to 10 μm, can be suitable.

As mentioned, the size of the fine holes, or mesh apertures or micro-pores of the membrane may affect the relation between the gas pressure building up in the chamber upstream of the membrane and the gas flow rate downstream of the membrane. Generally, when used to displace or level liquids higher pressures are needed with increasing viscosity, and when displacing or leveling particles higher pressures are needed with reducing particle size.

In addition to the afore-mentioned passage size considerations, both the mechanical properties of the membrane and the shape of the product metering device, can affect its sustainable pressure and/or the resulting flow rate. A variety of membranes can be suitable for a variety of desired effect. For instance, if the product metering device is to be used to level a liquid, formation of a thicker liquid layer would require a lower pressure than a thinner layer of the same liquid. Liquids of various viscosities may accommodate or require different membranes.

The membrane, in one embodiment, is formed of a pressure resistant non-swellable micro-porous membrane having micro pores of less than 50 μm in diameter, less than 40 μm, less than 30 μm, less than 20 μm, the pores approximate diameters being advantageously in the range of about 1 to 10 μm. In this context, the term "pores" needs to be understood to include cavities of any shape, e.g. snake-like. Preferred properties of the membrane, for at least some applications, are that it should be abrasion resistant, tear resistant, solvent resistant, hydrophobic, waterproof, and breathable. Its gas permeability should be low, in other words the membrane should offer significant flow resistance. Porous membranes can be defined by fraction of void spaces they may comprise. Membranes having a porosity of at least 40%, at least 50%, at least 60% or at least 70% can be suitable. Maximum porosity may depend on the particular material forming the membrane, those with higher tensile strength being compatible with higher porosity, while retaining satisfactory overall membrane mechanical properties. In some embodiments, porosity should not exceed 95%, 90% or 85%, depending on the flow resistance a particular material may offer under a certain gas pressure. In one embodiment, the membrane porosity is in the range of 60-90% or in the range of 75-85%.

The membrane can be, for example, Permair® Base Foil supplied by PIL Membranes Limited, UK. The material of the membrane may be polyurethane. The membrane should be substantially uniform and devoid of pinholes, thin spots and any such fault that may locally affect membrane efficacy. As the membrane is micro-porous, the necessary membrane thickness of a tensioned membrane would in practice depend on the specific density and shapes of the cavities at the point of interest.

In some embodiments, the membrane thickness could be in the 300-600 μm range, preferably 300-450 μm. The surface weight of the membrane may depend, in addition to the thickness of the membrane, on the material forming it, its density and the "porosity" level or number/dimension of fine holes per unit area. For materials having a relatively low density (e.g., plastic materials) and membranes made therefrom having a relatively high porosity, the surface weight of the membrane can be as low as 100 g/m$^2$, or even lower. For materials having a relatively high density (e.g., metals or alloys) and membranes therefrom having a relatively low porosity, the surface weight of the membrane can be up to an order of magnitude higher. Such membranes can have a surface weight of up to about 1200 g/m$^2$, 1000 g/m$^2$, 800 g/m$^2$, 600 g/m$^2$, or even up to about 400 g/m$^2$. Membranes surface weight can suitably be in the range of 100-300 g/m$^2$, 120-200 g/m$^2$ or 140-180 g/m$^2$. Membrane density may serve to estimate its porosity, when not otherwise provided by the supplier. Depending on the materials forming the membrane, its density can be in the range of about 0.3 g/cm$^3$ (e.g., for a membrane made of plastic materials with a porosity of about 75%) up to 8 g/cm$^3$ (e.g., for a membrane made of ceramic material with a porosity of 40-50%) or up to 4-5 g/cm$^3$ (e.g., for a membrane made of a metal or alloy). In one embodiment, the membrane density is in the range of 0.33-0.38 g/cm$^3$. Shrinkage of the membrane should preferably be no more than 8%.

The flow resistance of the membrane may be such as to allow a flow rate of 2 liters/minute/mm$^2$ at a pressure of about 1,000 kPa in the chamber 12. A membrane and operating conditions can be selected to yield a flow rate of up to 5 liters/minute/mm$^2$, or up to 3 liters/minute/mm$^2$ or even up to about 1 liter/minute/mm$^2$. Though the product metering device can be operated at any flow rate sufficient for the desired effect, such rate is generally of at least 0.01 liter/minute/mm$^2$, or at least 0.1 liter/minute/mm$^2$. Any flow rate not irreversibly deforming the membrane is permissible.

The membrane may be preformed in a mould, i.e. between a die and counter die, the die having substantially the shape of the body 10 at the mouth of the discharge opening 16. The membrane can be pressed in the mould in any suitable controlled manner, under conditions adapted to the composition and structure of the membrane, so that it retains the shape of the mould. For instance, the plastic membrane herein exemplified (Permair® Base Foil) was pressed in the mould for 1-2 hours whilst being subjected to heat treatment at 120-130° C. to retain the shape of the die. Different compressive forces, durations of time and temperatures can be appropriate for diverse membranes, as long as such preforming conditions do not negatively affect their performance. The preformed membrane can then be attached either mechanically, or by means of an adhesive, to the body of the product metering device.

Alternatively, the body of the product metering device may be used as the die, the deformation of the membrane taking place in situ. The heat treatment allows improved control of the mechanical properties of the membrane, gaining a better control of flow rate reductions at the nozzle exit. As can be seen from FIG. 4, the membrane 18 may mildly stretch and insignificantly move away from the mouth of the opening 16 under the action of the pressure difference across the membrane and it is believed that heat applied on the membrane while contacting the external surface of body of the product metering device, modifies the "extensibility" of the membrane surrounding the opening, allowing improved control of the extensibility of the membrane facing the opening.

For instance, the membrane can be formed in a suitable mould while being adhered to the body of the product metering device serving as the die. The mould may be lined up with a thin sheet preventing inadvertent adhesion of the product metering device body, adhesive or membrane to the walls of the mould. A stripe of foil of hot melt adhesive is positioned so as to cover the surfaces of the mouth of the product metering device adjacent to the openings, upon insertion of the product metering device body. The mould can then be heated to allow the adhesion of the adhesive foil to the product metering device body (e.g., for 1-2 hours at 130-140° C.). The thin protective sheet can be taken of the mould. Adhesive is carefully removed from the area of the openings before inserting in the mould the desired membrane to be then shaped by the product metering device already treated to bear adhesive areas to attach the membrane as it adopts the desired form. The mould comprising the membrane and the adhesive treated body can then be further heated to allow the adhesion of the membrane to the body, via the pre-applied hot melt adhesive. Such heating can be performed at any temperature and for any duration compatible with the selected membrane and adhesive. Second heating can for instance be for 1.5-2 hrs at about 100° C. for a hot melt adhesive made of ethylene acrylic acid (EAA). Following adhesion of the membrane to the body of the product metering device the mould is cooled back to ambient temperature (e.g., by air cooling) and the device can be removed from the mould for use. Spacers may be used between parts of the mould to control pressure that may be differently applied on various areas of the membrane (e.g., to prevent deleterious modifications of micro pore structures in the region of the openings).

Though exemplified above with a hot melt adhesive, securing of the membrane to the body of the product metering device can be achieved by any other type of non-reactive adhesives compatible with the membrane and the product metering device, such as drying adhesives, pressure-sensitive adhesives or contact adhesives; as well as reactive adhesives, whether one-part or multi-part.

The adhesive material selected to secure the membrane to the body of the product metering device and/or the conditions under which such adhesion is performed can additionally serve to render the membrane substantially impervious to gas flow in such areas, the fine holes, mesh apertures or micro-pores, as the case may be, remaining "operative" (i.e. "open") only or essentially in the area of the mouth opening.

In Permair® Base Foil, the micro-pores are randomly distributed and do not necessarily form straight micro channels. This relative tortuosity was found to produce superior results to forming holes of 50 μm diameter in steel foil. Without wishing to be bound to any particular theory, it is believed that for passages of similar cross sectional dimensions, those "following" a more tortuous path across the membrane thickness more efficiently maintain a relatively low drop in pressure across the membrane and/or reduce the flow rate of the compressed gas being downstream discharged. Such "tortuous" property of micro passages through the membrane, while not being essential, may facilitate a more even "transmission" of the inner pressure through the membrane (and to a facing surface) and/or diffusion of a discharged flow rate. Taking for simplicity of illustration an array of evenly spaced straight micro channels having a circular cross section, the apertures on the downstream side of the membrane may discharge a series of micro jets having a broadly cylindrical or conical stream shape. Independently of the many parameters that may affect the interference between neighboring jets and the impact of such micro jets' array on the target surface, the resulting "pattern" may be considered relatively predictable. Taking now a micro-porous membrane wherein the path followed by the gas upstream of each aperture may vary, even if the downstream apertures are relatively homogeneously distributed on the membrane, in such a case the resulting jets may have less predictable shapes and flow paths. It is believed that such phenomenon provides for an overall more homogeneous or "smoother" impact on the target surface.

The Applicant has conducted a comparative experiment with a product metering device with and without a membrane as previously described. Briefly a product metering device was mounted on a coating table, so as to be displaceable with respect to a substrate attached to the table. A two centimeter long "line" of a relatively viscous (~150 mPa·s at 24° C.) film-forming test solution was applied to a stripe of plastic foil (made of polyester and having a thickness of about 100 μm), the foil being fixed on the table so as to be overlapped by the product metering device during its motion. The liquid (20 wt. % of NeoCryl® BT9 of DSM Coating Resins, LLC. diluted in distilled water and fully neutralized) was applied downstream of and parallel to the product metering device on one end of the stripe shortly before the knife was displaced toward the test liquid and the other end of the plastic stripe. Few parameters were controlled: a) the size of the gap between the tip of the product metering device and the foil (at steps of either 200 μm, 400 μm or 800 μm); and b) the air pressure (0 bar, 0.5 bar, 2 bar, 3 bar, or 4 bar, 1 bar being equivalent to 100 kPa. The flow rate generated at the tip of the nozzle by the various pressure conditions, with or without a membrane was monitored.

Following the passage of the product metering device and the consequential spreading of the finite amount of test liquid, the plastic stripe was transferred to a hot plate and the test liquid was dried for 5 minutes at 60° C. The dried film was visually assessed for relative smoothness or roughness, as well as thickness as measured at many individual points along the width and the length of the stripe (and dried layer thereon).

The product metering device was tested both without a membrane, but with air (conventional product metering device control), and with a membrane, Permair® Base Foil having micro-pores of about 10-50 μm. The tip of the product metering device was in each case positioned above the surface of the test liquid, the layer of test liquid resulting from non-contact displacement of the product metering device and gas flow pattern generated thereby.

These experiments demonstrated that under the tested conditions a conventional product metering device without a membrane created turbulence on the surface of the layer being formed by the product metering device displacement over the test liquid, so that the dried test liquid displayed a rough/wavy looking surface. On the other hand, and under same conditions of gap size and air pressure, the presence of the membrane (at a flow rate of 1.14 liters/minute/$mm^2$) enabled the dried layer of test liquid to have a smooth surface, the removal of excess liquid (being pushed downstream by the product metering device) advantageously providing for a uniform thickness as long as the downstream liquid was sufficient.

Similar experiments were performed with solid beads having a diameter of about 1-3 μm, the spherical particles being initially positioned on a surface to which they were relatively adhesive. In the absence of a membrane, the product metering device erratically displaced the particles to yield a low surface coverage with isolated clusters of beads, the beads' clusters estimated to cover less than 10% of the surface of the substrate. In presence of a membrane secured thereto, the product metering device evenly distributed/applied the beads so as to form a relatively continuous film of particles with a coverage estimated to be at least 65% of the surface. The discontinuities observed in such coating were typically of the order of one or two particle size. It is to be understood that such coverage results from a finite amount of particles subjected to a single pass of the product metering device.

In the description and claims of the present disclosure, each of the verbs, "comprise" "include" and "have", and conjugates thereof, are used to indicate that the object or objects of the verb are not necessarily a complete listing of members, components, elements, steps or parts of the subject or subjects of the verb. These terms encompass the terms "consisting of" and "consisting essentially of".

As used herein, the singular form "a", "an" and "the" include plural references and mean "at least one" or "one or more" unless the context clearly dictates otherwise.

Positional or motional terms such as "upper", "lower", "right", "left", "bottom", "below", "lowered", "low", "top", "above", "elevated", "high", "vertical", "horizontal", "backward", "forward", "upstream" and "downstream", as well as grammatical variations thereof, may be used herein for exemplary purposes only, to illustrate the relative positioning, placement or displacement of certain components, to indicate a first and a second component in present illustrations or to do both. Such terms do not necessarily indicate that, for example, a "bottom" component is below a "top" component, as such directions, components or both may be flipped, rotated, moved in space, placed in a diagonal orientation or position, placed horizontally or vertically, or similarly modified.

Unless otherwise stated, the use of the expression "and/or" between the last two members of a list of options for selection indicates that a selection of one or more of the listed options is appropriate and may be made.

In the discussion, unless otherwise stated, adjectives such as "substantially" and "about" that modify a condition or relationship characteristic of a feature or features of an embodiment of the present technology, are to be understood to mean that the condition or characteristic is defined to within tolerances that are acceptable for operation of the embodiment for an application for which it is intended.

While this disclosure has been described in terms of certain embodiments and generally associated methods, alterations and permutations of the embodiments and methods will be apparent to those skilled in the art. The present disclosure is to be understood as not limited by the specific embodiments described herein, but only by the scope of the appended claims.

The invention claimed is:

1. A product metering device for leveling, or regulating the depth of a flowable product coating a surface that is movable relative to the metering device, the surface having an excess of the product placed upon a portion thereof, the device comprising a gas knife operative to direct a gas curtain towards the movable surface to achieve a substantially even depth of product coating on the surface on a downstream side of the product metering device, while confining excess material in an area upstream of the product metering device, the gas knife comprising a body having an interior chamber, an inlet for connecting the chamber to a source of gas under pressure greater than an ambient pressure; an opening communicating with the chamber and having a mouth through which a stream of the gas is discharged, and a porous or reticulated pressure reducing membrane secured to an outer surface of the body of the gas knife so as to overlie the mouth of the opening and to be traversed by the gas stream discharged from the mouth of the opening, the gas passing through the pressure reducing membrane forming the gas curtain that is directed towards the product coated surface; wherein the pressure reducing membrane has a flow resistance such that, under a pressure differential of 1,000 kPa across the membrane, a gas flow rate therethrough is in the range of 0.01 to 5 liters/minute/$mm^2$.

2. The apparatus of claim 1, wherein the pressure reducing membrane has a flow resistance such that, under a pressure differential of 1,000 kPa across the membrane, the gas flow rate therethrough is in a range of 0.1 to 3 liters/minute/$mm^2$ or 1 to 2 liters/minute/$mm^2$.

3. The apparatus of claim 1, wherein the mouth of the opening is disposed at a distance from the surface so as to form a gap between the pressure reducing membrane and the surface, the gap being traversed by the gas curtain and is less than 2 mm or less than 0.5 mm.

4. The apparatus of claim 3, wherein the pressure developed by the source of gas in the chamber and/or the gap causes the gas curtain to flow substantially without turbulence in the gap so as to achieve an even depth of product coating on the surface on the downstream side of the product metering device, variations in coating depth being less than 10% of an average depth of the coating.

5. The apparatus of claim 1, wherein the pressure reducing membrane is formed of a hydrophobic material.

6. The apparatus of claim 1, wherein the pressure reducing membrane is formed of a hydrophilic material.

7. The apparatus of claim 1, wherein the pressure reducing membrane is formed of a sheet made of at least one of a metal, ceramic, silica and plastic material, the sheet comprising fine holes having a diameter of 50 μm or less.

8. The apparatus of claim 1, wherein the pressure reducing membrane is a mesh formed of at least one of metal, ceramic, silica and plastic fibers, the mesh having a mesh density such that an aperture formed between adjacent fibers is of 50 μm or less.

9. The apparatus of claim 1, wherein the pressure reducing membrane is formed of a pressure resistant micro-porous membrane having micro pores of less than 50 μm in diameter, the membrane being made of at least one of a metal, ceramic, silica and plastic material.

10. The apparatus of claim 1, wherein the pressure reducing membrane is formed of a pressure resistant micro-porous membrane having micro pores of a diameter of 10 nm or more, the diameter being no larger than 10 μm.

11. The apparatus of claim 1, wherein the pressure reducing membrane is formed of at least one material selected from the group comprising ethylene vinyl acetate (EVA), high-density polyethylene (HDPE), polyamide (PA), polycarbonate (PC), polyethylene (PE), polyethersulfone (PES), polyester (PET), polypropylene (PP), polytetrafluoroethylene (PTFE), polyurethane (PU or TPU), polyvinylidene fluoride (PVDF), and ultra-high molecular weight polyethylene (UHMWPE).

12. The apparatus of claim 1, wherein the pressure reducing membrane has a thickness in the range of 300-600 μm, or in the range of 300-450 μm.

13. The apparatus of claim 1, wherein the pressure reducing membrane has a weight which is in a range selected from a group consisting of 100-1200 g/$m^2$, 100-300 g/$m^2$ and 140-180 g/$m^2$.

14. The apparatus of claim 1, wherein the density of the pressure reducing membrane has a density in a range of 0.3-8.0 g/$cm^3$ or 0.33-0.38 g/$cm^3$.

15. A gas knife for directing a gas curtain towards a surface movable relative thereto in order to level, or regulate the depth of, a coating of a flowable product on the surface by displacing from the surface any product in excess of a predetermined depth, the gas knife comprising a body having an interior chamber, an inlet for connecting the chamber to a source of gas under pressure greater than an ambient pressure; an opening communicating with the chamber and having a mouth through which a stream of the gas is discharged, and a porous or reticulated pressure reducing membrane secured to an outer surface of the body of the gas knife so as to overlie the mouth of the opening and to be traversed by the gas stream discharged from the mouth of the opening, the gas passing through the pressure reducing membrane forming the gas curtain that is directed towards the product coated surface;

wherein the pressure reducing membrane has a flow resistance such that, under a pressure differential of 1,000 kPa across the membrane, a gas flow rate therethrough is in the range of 0.01 to 5 liters/minute/$mm^2$.

16. The gas knife of claim 15, wherein the pressure reducing membrane has a flow resistance such that, under a pressure differential of 1,000 kPa across the membrane, a gas flow rate therethrough is in a range selected from a group consisting of 0.01 to 5 liters/minute/$mm^2$ or 1 to 2 liters/minute/$mm^2$.

* * * * *